US005339130A

United States Patent [19]

Landis

[11] Patent Number: 5,339,130

[45] Date of Patent: Aug. 16, 1994

[54] METHOD AND APPARATUS FOR HANDLING A PHOTOGRAPHIC FILMSTRIP AS THE FILMSTRIP EXITS A FILM PROCESSOR

[75] Inventor: Newton C. M. Landis, Penfield, N.Y.

[73] Assignee: Eastman Kodak Company, Rochester, N.Y.

[21] Appl. No.: 55,480

[22] Filed: May 3, 1993

[51] Int. Cl.[5] ..... G03D 3/08

[52] U.S. Cl. ..... 354/319

[58] Field of Search ..... 354/319–324; 355/41, 40, 72, 73; 264/25; 242/55; 271/3.1, 84

[56] References Cited

U.S. PATENT DOCUMENTS

| | | | |
|---|---|---|---|
| 2,137,601 | 11/1938 | Abrams | 88/17 |
| 3,552,668 | 1/1971 | Kanno | 242/55 |
| 3,806,574 | 4/1974 | Arvidson, Jr. | 242/55 |
| 4,110,774 | 8/1978 | Krehbiel et al. | 354/345 |
| 4,627,719 | 12/1986 | Nitsch et al. | 355/41 |
| 4,892,689 | 1/1990 | Van Cappellen et al. | 264/25 |
| 4,994,214 | 2/1991 | Stevens et al. | 264/25 |
| 5,026,036 | 6/1991 | Takahashi | 271/3.1 |
| 5,131,644 | 7/1992 | Dubois | 271/84 |

*Primary Examiner*—D. Rutledge
*Attorney, Agent, or Firm*—David A. Howley

[57] ABSTRACT

A photographic filmstrip is initially coiled about a spool inside a supply cartridge such that a core set is imparted to the filmstrip causing the filmstrip to curl in a longitudinal direction when not constrained. A leading end of the filmstrip is passed adjacent constraining means after the leading end of the film exits a film processor. The leading end of the filmstrip is contacted against the constraining means such that, as the filmstrip continues to exit the film processor, the filmstrip coils up against the constraining means to prevent the filmstrip from curling back against the exit aperture from the film processor.

7 Claims, 5 Drawing Sheets

METHOD AND APPARATUS FOR HANDLING A PHOTOGRAPHIC FILMSTRIP AS THE FILMSTRIP EXITS A FILM PROCESSOR

FIELD OF THE INVENTION

This invention relates generally to the field of photography, and more particularly to photofinishing equipment. Specifically, the invention relates to a method and apparatus for handling a photographic filmstrip as the filmstrip exits a film processor.

BACKGROUND OF THE INVENTION

When photographic film is stored on a small core for extended periods of time and/or at elevated temperatures, the film takes on a core set. Core set of the film causes the film to curl in a longitudinal direction when the film is removed from the core and is unconstrained.

With conventional films that include a cellulose triacetate (CT) base, most of the core set imparted to the film is removed during processing of the film. The core set is removed because the film emulsion and base both absorb significant amounts of water when exposed to water-based solutions during processing. As a result, the processed film typically exits a film processor in long strips which are not curled. These strips fall into a receptacle and then are manually carried to a photographic printer where prints of the images on the film are made.

Other types of films, such as those which include a polyethylene terepthalate (PET) or polyethylene napthalate (PEN) base, lose very little core set during processing. This is due to the fact that these types of film bases absorb very little water during processing in water based solutions. Consequently, as this type of film exits the film processor, the film tends to curl back up on itself.

PROBLEMS TO BE SOLVED BY THE INVENTION

With CT based films, as stated above, the film exits the processor in a long strip. The images on the film are not protected in any way and can be damaged as the film falls from the film processor into a receptacle. The images may be further damaged by an operator during handling of the film and loading of the film into a photographic printer. For example, fingerprints and/or scratches may be imparted to the film during handling by the operator.

With films having a base made of a water-phobic material, such as PET or PEN, once a leader card has been removed from a lead end of the film, the film curls up against where the film exited the film processor. The curled up film can become entangled at the processor exit, for example, becoming wrapped around a pinch roller, causing damage to the film.

SUMMARY OF THE INVENTION

According to one aspect of the invention, a photographic filmstrip is initially coiled about a spool inside a supply cartridge such that a core set is imparted to the filmstrip causing the filmstrip to curl in a longitudinal direction when not constrained. A leading end of the filmstrip is passed adjacent constraining means after the leading end exits the film processor. The leading end of the filmstrip is contacted against the constraining means such that as the filmstrip continues to exit the film processor the filmstrip coils up against tile constraining means to prevent the filmstrip from curling back against where it exits from the film processor.

According to other aspects of the invention, a leader card is released from the leading end of the filmstrip to allow the leading end of the film to contact the constraining means. A receptacle is used for catching the coiled up filmstrip after a trail end of the filmstrip has exited the film processor. The constraining means can include a pair of hooks and means for guiding the filmstrip such that the pair of hooks respectively contact the filmstrip along the filmstrip's non-image edges.

ADVANTAGEOUS EFFECT(S) OF THE INVENTION

An advantage of the present invention is that as the film exits the film processor, it is coiled upon itself into a compact unit. The images on the film are located inside the coiled up film and are therefore protected from damage when the film falls into a receptacle or is transported to and loaded on a photographic printer. The present invention also prevents the coiled up film from becoming entangled at the exit from the film processor.

DETAILED DESCRIPTION OF THE INVENTION

The invention is disclosed as being embodied preferably in a film processor. Because the features of a film processor are generally known, the description which follows is directed in particular only to those elements forming part of or cooperating directly with the disclosed embodiment. It is to be understood, however, that other elements may take various forms known to a person of ordinary skill in the art.

Figure 1:
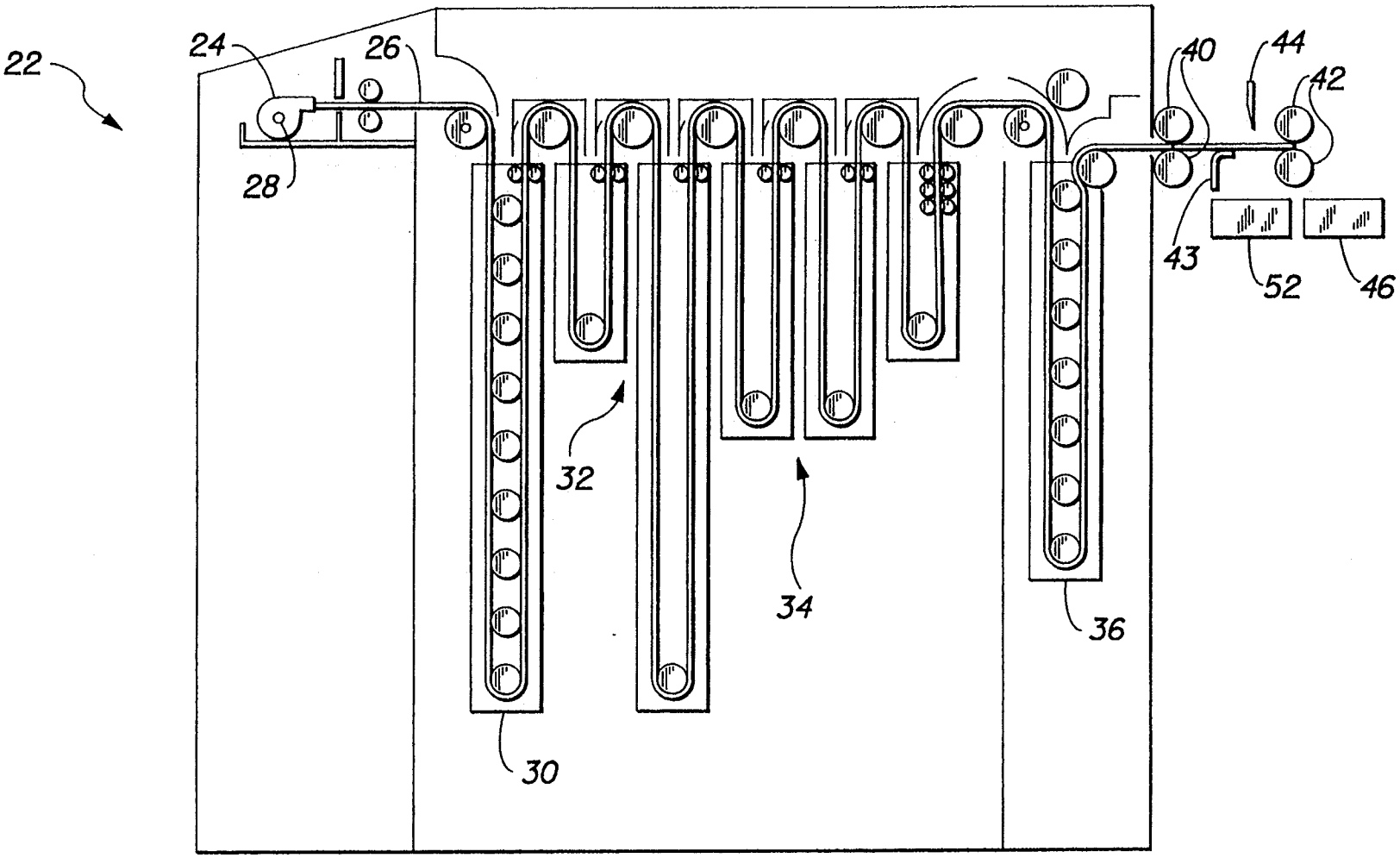
FIG. 1 is a side view of a film processing apparatus.
Figure 2:
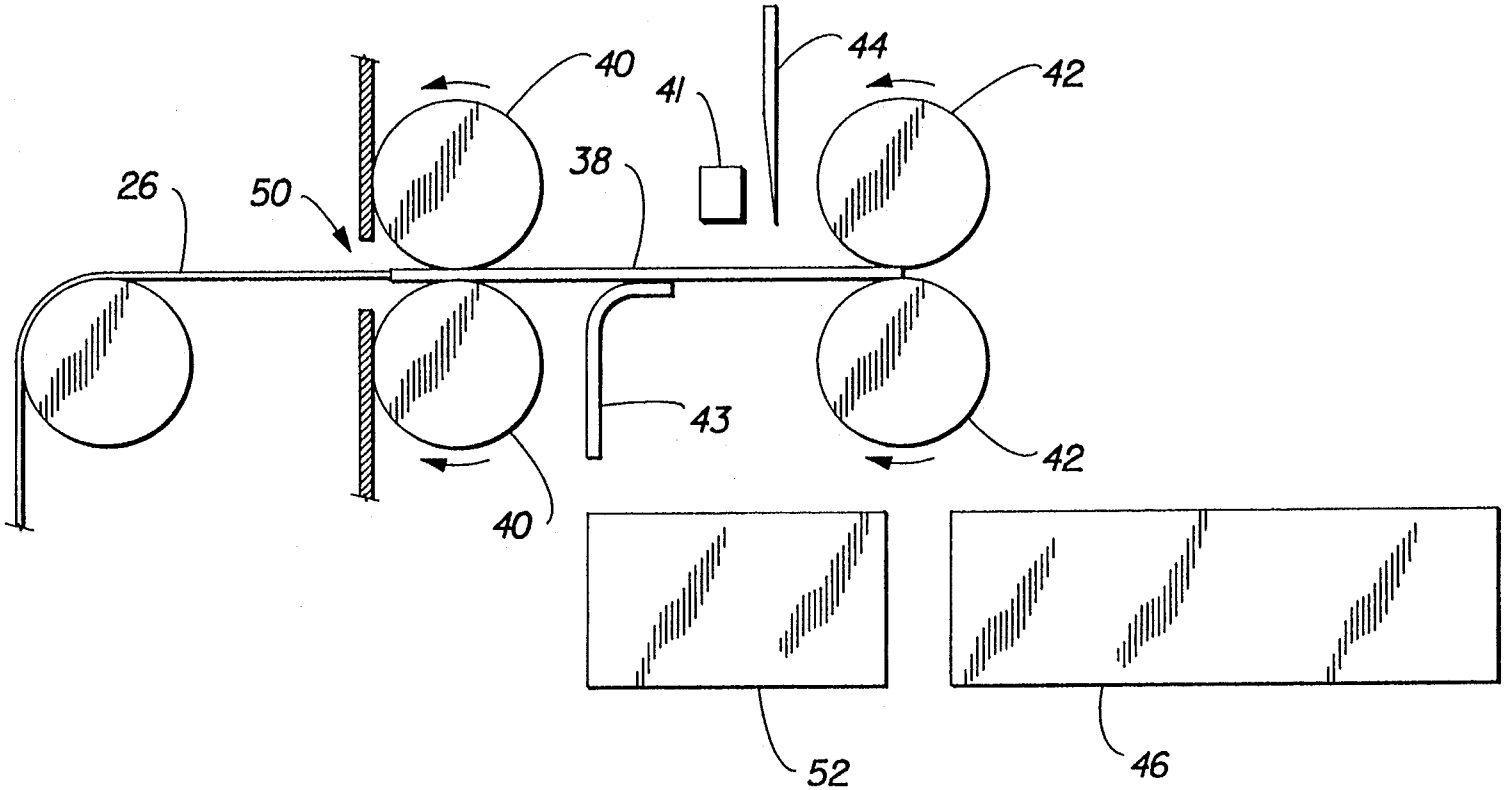
FIGS. 2–5 are side views of the exit portion of the film processing apparatus of FIG. 1.
Figure 3:
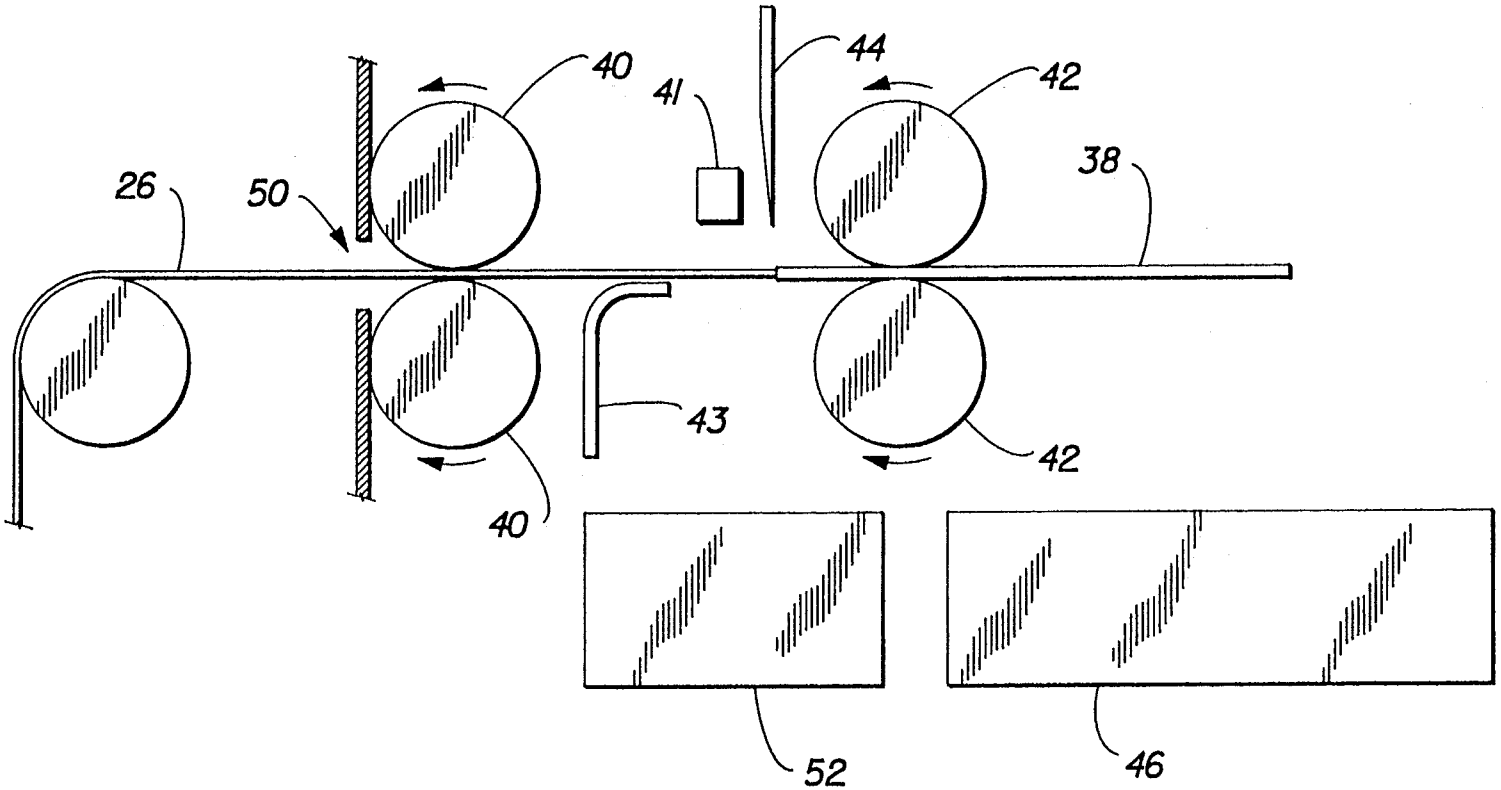

Referring now to the drawings, FIG. 1 shows a film processor designated generally by the reference numeral 22. A film cartridge 24 contains a photographic film 26 which preferably includes a base made of a water-phobic material such as PET or PEN. The film is stored on a core 28 in the cartridge with a small lead portion of the film protruding from the cartridge. The film has a core set imparted to it from being (1) stored on the core for an extended period of time and/or (2) exposed to elevated temperatures.

A leader card is attached to the small lead portion of the film protruding from cartridge 24. The cartridge is loaded into the film processor. The leader card is pulled through processor 22 which pulls film 26 through the processor. The film enters a developing tank 30, filled with a developing solution, and then enters one or more fixing tanks 32 filled with a fixing solution such as bleach. The film enters one or more rinsing tanks 34 where the film is rinsed with water. After being rinsed, film 26 enters a drier section 36 where the film is dried. The film then exits the film processor.

Referring to FIGS. 2–5, as a leader card 38 exits the film processor it is propelled by a pair of pinch rollers 40 away from the processor toward a second pair of pinch rollers 42. Pinch rollers 42 continue to pull the leader card away from the film processor. The leader card and film pass over a pair of hooks 43 (one hook is hidden from view). Hooks 43 are preferably smooth and made of stainless steel wire having a diameter of between about 0.16 6cm 0.64 cm. The hooks have an upside down "L" shape.

A sensor 41, which may include a light emitting diode (LED) and a charge coupled device (CCD), detects when the lead edge of the film has reached the sensor. Detection of the lead edge of the film can be determined by noting a change in reflectance of the LED light between the leader card and the film. After the lead edge of the film is detected a blade 44 is actuated to slice the film apart from the leader card. When the leader card 38 exits pinch rollers 42, the leader card falls into a leader card bin 46. The leader card can be taken from the bin by an operator and returned to the front of the film processor for reuse.

Figure 4:
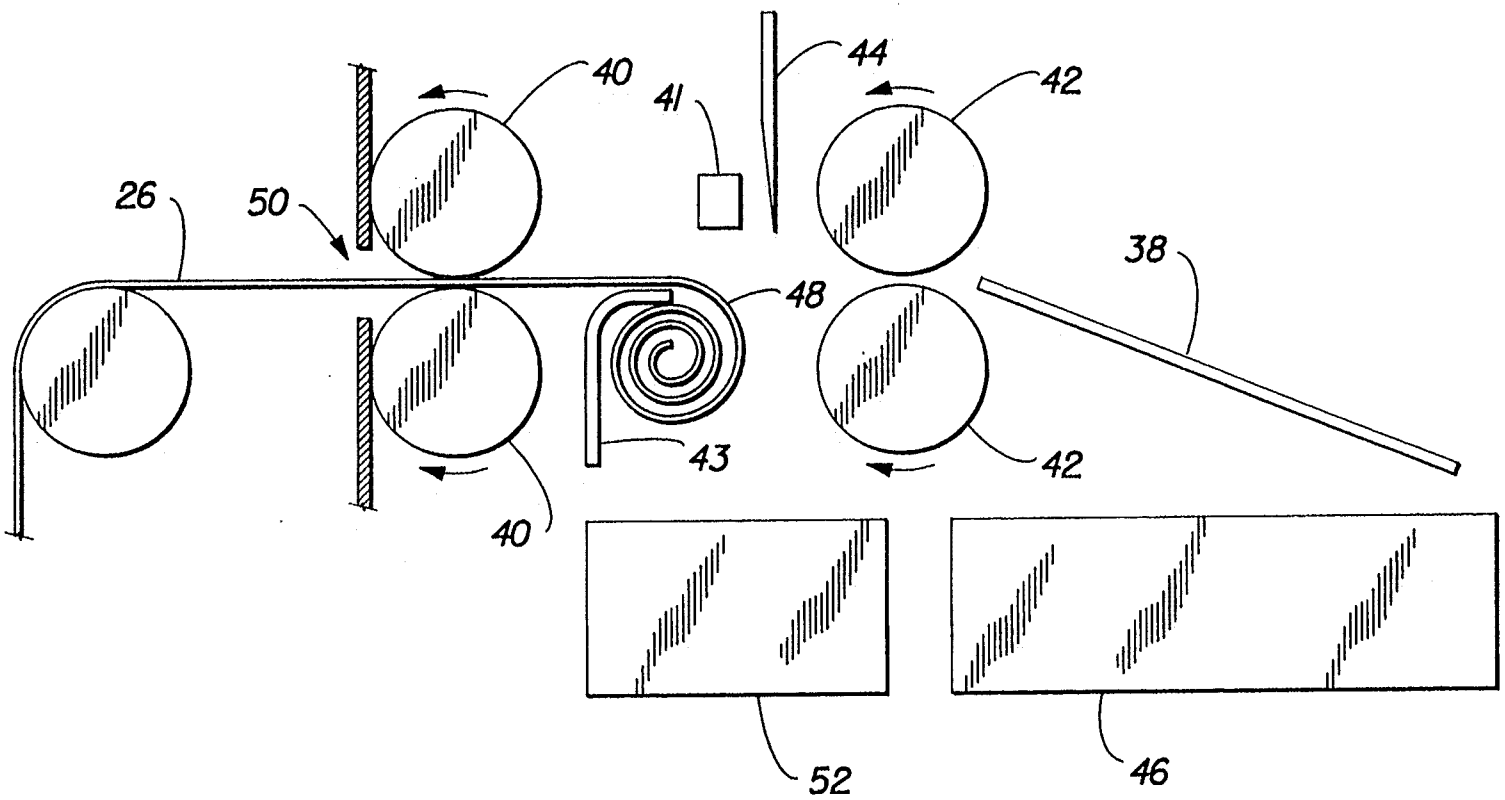

After the leader card has been sliced away from the lead edge of the film, there is nothing constraining the lead edge of the film. As a result, the lead edge of the film curls up into a cylinder 48 (FIG. 4). Hooks 43 constrain the film from curling back into pinch rollers 40 and an exit 50 of the film processor. The hooks are spaced apart such that they contact the non-image edge of the film. Film guides (not shown) may be used to keep the film properly aligned relative to the hooks.

Figure 5:
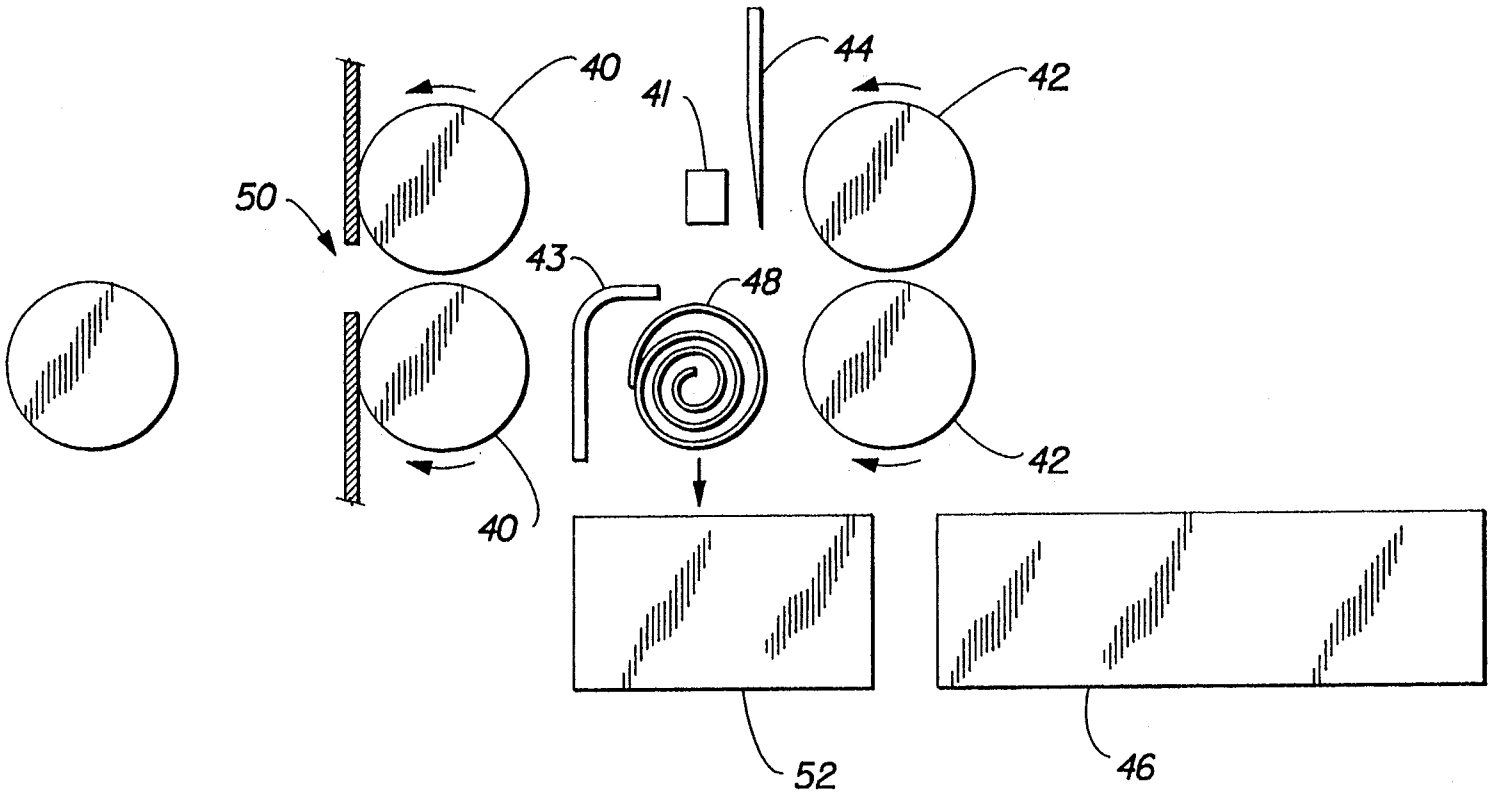

As the film continues to exit the film processor the film continues to coil up into a cylinder against hooks 43. After the trail end of the film has exited pinch rollers 40, the cylinder of film falls into a receptacle 52 (FIG. 5). Preferably the cylinder of film is coiled emulsion side in to protect the images on the film. It is also preferred that a trail end of film, forming an outer wrap of film on cylinder 48, not contain any images. As such, even if the outer wrap of film gets scratched or dirty, there will be no effect on image quality in prints made from the film. The cylinder of film can then be taken by an operator and loaded into a photographic printer with little danger of incurring film damage during transport or loading.

The invention has been described with reference to a preferred embodiment. However, it will be appreciated that variations and modifications can be effected by a person of ordinary skill in the art without departing from the scope of the invention.

PARTS LIST FOR FIGS. 1–5

22 film processor
24 film cartridge
26 photographic film
28 core
30 developing tank
32 fixing tanks
34 rinsing tanks
36 drier section
38 leader card
40 pinch rollers
41 sensor
42 pinch rollers
43 hooks
44 blade
46 leader card bin
48 film cylinder
50 film processor exit
52 film receptacle

What is claimed is:

1. A method of handling a photographic filmstrip as the filmstrip exits a film processor, wherein the filmstrip is initially coiled about a spool inside a supply cartridge such that a core set is imparted to the filmstrip causing the filmstrip to curl in a longitudinal direction when not constrained, said method comprising the steps of:

passing a leading end of said filmstrip adjacent constraining means after said leading end exits said film processor; and contacting said leading end of said filmstrip against said constraining means such that, as said filmstrip continues to exit said film processor, said filmstrip coils up against said constraining means to prevent said filmstrip from curling back against where it exits from said film processor.

2. The method of claim 1, wherein said contacting step includes the step of:

releasing a leader card from said leading end of said filmstrip to allow said leading end to contact said constraining means.

3. The method of claim 1, further comprising the step of:

catching a coiled up filmstrip in a receptacle after a trail end of said filmstrip has exited said film processor.

4. Apparatus for handling a photographic filmstrip as the filmstrip exits a film processor, wherein said filmstrip is initially coiled about a spool inside a supply cartridge such that a core set is imparted to the filmstrip causing the filmstrip to curl in a longitudinal direction when not constrained, said apparatus comprising:

constraining means for preventing the filmstrip from curling back against an exit aperture of said film processor;

means for passing a leading end of said filmstrip adjacent said constraining means after said leading end exits said film processor; and means for contacting said leading end of said filmstrip against said constraining means such that as said filmstrip continues to exit said film processor said filmstrip coils up against said constraining means.

5. The apparatus of claim 4, wherein said contacting means includes:

means for releasing a leader card from said leading end of said filmstrip to allow said leading end to contact said constraining means.

6. The apparatus of claim 4, further comprising:

a receptacle for catching the coiled up filmstrip after a trail end of said filmstrip has exited said film processor.

7. The apparatus of claim 4 wherein said constraining means includes a pair of hooks and means for guiding said filmstrip such that said pair of hooks respectively contact said filmstrip along the filmstrip's non-image edges.

* * * * *